US009719667B2

(12) United States Patent
Drury et al.

(10) Patent No.: US 9,719,667 B2
(45) Date of Patent: Aug. 1, 2017

(54) CLIP FOR PROVIDING LIGHT TO A SPA FEATURE

(71) Applicant: Custom Molded Products, Inc., Newnan, GA (US)

(72) Inventors: William J. Drury, Peachtree City, GA (US); H. Charles Li, Peachtree City, GA (US); Zachary T. Vogtner, Atlanta, GA (US)

(73) Assignee: Custom Molded Products, LLC, Newnan, GA (US)

( * ) Notice: Subject to any disclaimer, the term of this patent is extended or adjusted under 35 U.S.C. 154(b) by 0 days.

(21) Appl. No.: 14/078,005

(22) Filed: Nov. 12, 2013

(65) Prior Publication Data

US 2014/0091184 A1 Apr. 3, 2014

Related U.S. Application Data

(63) Continuation-in-part of application No. 13/032,090, filed on Feb. 22, 2011, now abandoned, and a continuation-in-part of application No. 14/077,349, filed on Nov. 12, 2013, now Pat. No. 9,239,146.

(51) Int. Cl.
*F21V 21/088* (2006.01)
*F21V 33/00* (2006.01)
*F21W 131/401* (2006.01)

(52) U.S. Cl.
CPC ..... *F21V 21/088* (2013.01); *F21V 33/00* (2013.01); *F21W 2131/401* (2013.01); *Y10T 29/49947* (2015.01)

(58) Field of Classification Search
CPC ..... A61H 33/6063; A61H 33/027; A61H 33/0087; A61H 33/6052; A61H 33/02; F21S 8/00; F21V 21/088; F21W 2131/401; Y10T 29/49947
USPC ... 248/229.16, 229.26, 228.7, 231.81, 316.7; 4/541.6; 362/96, 101, 396
See application file for complete search history.

(56) References Cited

U.S. PATENT DOCUMENTS 4,728,147 A * 3/1988 Dutton ..... A47C 7/62 248/230.8
5,941,628 A * 8/1999 Chang ..... F21V 19/0005 362/249.01
6,116,951 A * 9/2000 Shu ..... F21V 19/0005 439/574
6,186,645 B1 * 2/2001 Camarota ..... F21S 8/032 362/240
6,267,342 B1 * 7/2001 Huang ..... F21V 21/08 248/316.7
6,341,881 B1 * 1/2002 Huang ..... F21V 19/0005 362/249.01
6,428,184 B1 * 8/2002 Huang ..... F21V 21/088 362/249.01

(Continued)

*Primary Examiner* — Muhammad Ijaz
(74) *Attorney, Agent, or Firm* — Laurence P. Colton; Smith Tempel Blaha LLC

(57) ABSTRACT

A clip and system for providing light to a spa feature, having a clip for holding a light emitting device and a spa feature having a housing connector, the spa feature and the housing connector being manufactured at least in part from a clear material and having a connector allowing the attachment of the clip to the spa feature, the clip having a support structure for containing and/or supporting the light emitting device and a clip connector for attaching the clip to the spa feature.

6 Claims, 20 Drawing Sheets

(56) References Cited

U.S. PATENT DOCUMENTS

| | | | | |
|---|---|---|---|---|
| 6,510,277 | B1 * | 1/2003 | Dongo | A61H 33/6063 385/147 |
| 6,644,561 | B1 * | 11/2003 | Daane | B05B 15/00 200/61.58 R |
| 6,676,270 | B2 * | 1/2004 | Kostal | F41H 9/10 362/102 |
| 6,776,506 | B2 * | 8/2004 | Tseng | F21S 4/20 362/249.01 |
| 7,178,933 | B1 * | 2/2007 | Chuang | B62J 6/02 362/106 |
| 7,637,381 | B2 * | 12/2009 | Foxx | B61G 7/00 213/76 |
| 7,798,673 | B2 * | 9/2010 | Yang | F21S 10/002 362/101 |
| 8,011,604 | B1 * | 9/2011 | Holtsnider | B05B 15/061 239/200 |
| 8,079,726 | B1 * | 12/2011 | Hui | F21S 8/00 362/101 |
| 8,756,723 | B2 * | 6/2014 | Loyd | B05B 1/3026 4/541.6 |
| 2006/0225199 | A1 * | 10/2006 | Hatrick-Smith | A61H 33/027 4/541.6 |
| 2010/0046199 | A1 * | 2/2010 | Carter | A61H 33/02 362/96 |
| 2012/0085516 | A1 * | 4/2012 | McClellan | F21V 15/013 165/80.3 |
| 2014/0131472 | A1 * | 5/2014 | Eddington | A61H 33/6063 239/18 |

* cited by examiner

CLIP FOR PROVIDING LIGHT TO A SPA FEATURE

STATEMENT OF RELATED APPLICATIONS

This application claims the benefit of U.S. patent application Ser. No. 13/302,090 having a filing date of 22 Feb. 2011. This application also claims the benefit of U.S. patent application Ser. No. 14/077,349 having a filing date of 12 Nov. 2013.

BACKGROUND OF THE INVENTION

Technical Field

The present invention generally is in the field of devices for providing ambient and/or aesthetic light to a spa and for generating lighted flows of water or aerated water, and more particularly is in the field of waterjet devices for generating an aesthetically pleasing illumination to or an illuminated flow of water or aerated water into spas, swimming pools, tubs and the like. The present invention also generally is in the field of devices for providing ambient and/or aesthetic light to a spa feature, and also more particularly is in the field of spa features that can be illuminated and for illuminating spa features and areas in, on, and around spas, swimming pools, tubs and the like.

Prior Art

Few applications derive more benefit from the addition of aesthetically pleasing waterjets, such as waterjets capable of introducing a lighted stream of water or simply lighted waterjets, than artificial bodies of water such as spas, swimming pools, and tubs. The popularity of spas, hot tubs and other such structures is in part associated with their numerous health benefits. For those who enjoy spending time in a spa or hot tub, a more aesthetically pleasing experience adds to the enjoyment. For example, the addition of light to an artificial body of water, especially at night, can provide a substantial decorative effect coupled with the relaxing background sound generated from the water flow. Lighted waterjets are even more desirable due to their enhanced visual appeal.

Waterjets can be multi-component devices comprising a housing structure and a nozzle structure. Generally, the housing is attached to the sidewall or floor of the spa for introducing water into the spa, but also sometimes is attached to the outer rim of the spa or the deck proximal to the spa for jetting an angled flow or fountain of water into the spa. The housing is most often a static device with few or no movable components and allows for the retaining of the nozzle structure and for the attachment of water and air lines to provide water and air to the nozzle. The nozzle structure can be a static device as well, allowing for the injection of water, air or aerated water into the spa. Often, the nozzle structure is a dynamic device that allows for the control of the velocity and direction of water, air, or aerated water into the spa. The nozzle structure can be part of the housing in that the nozzle structure can be an integral part of the housing. However, in many cases, the nozzle structure is a separate structure that can be removably inserted into the housing. This removable configuration allows for the replacement of nozzle structures in the event a nozzle structure fails or in the event the user desires to use a nozzle structure having a different configuration.

Spas also often comprise lights, both for practical purposes and for aesthetic purposes. However, these lights generally are simple white, yellow, or colored light fixtures in or proximal to the spa. Various fountains and fountain fixtures also have lights incorporated therein, including lights for illuminating the water flow. Often, it is difficult to change the lighting fixture and/or the light bulbs in such fixtures.

Accordingly, there is a need for a device that allows for the transmission of light into a spa or the like via the waterjet and/or the water jet housing. There is also a need for a device that introduces light into a spa or the like that can be utilized with a minimum of manufacturing and installation costs. There is a further need for such a device having the advantageous characteristic of simple access to the light generating device (for example and LED or a bulb) without having to resort to discarding the housing or waterjet.

Accordingly, there is a need for new and different lighting devices and methods for illuminating cup holders and cup holder areas of spas, swimming pools, hot tubs, garden baths, and the like, and for lighting devices and methods for generating aesthetically pleasing light in, on and around cup holders and cup holder areas of spas, swimming pools, hot tubs, garden baths, and the like. There also is a need for new and different lighting devices and methods for illuminating cup holders and cup holder areas of spas, swimming pools, hot tubs, garden baths, and the like, and for lighting devices and methods for generating aesthetically pleasing light in, on and around cup holders and cup holder areas of spas, swimming pools, hot tubs, garden baths, and the like having a permanent or semi-permanent lighted cup holder base with removable and replaceable inserts having different aesthetic designs and shapes. There is a further need for new and different lighting devices and methods for illuminating cup holders and cup holder areas of spas, swimming pools, hot tubs, garden baths, and the like, and for lighting devices and methods for generating aesthetically pleasing light in, on and around cup holders and cup holder areas of spas, swimming pools, hot tubs, garden baths, and the like having a permanent or semi-permanent lighted cup holder base with removable and replaceable inserts whereby the spa, swimming pool, hot tub, garden bath, or the like can be customized by the owner.

Accordingly, there is a need for new and different lighting devices and methods for illuminating the interior of and/or the area surrounding spas, swimming pools, hot tubs, garden baths, and the like, and for lighting devices and methods for generating aesthetically pleasing light in, on, and around spas, swimming pools, hot tubs, garden baths, and the like. There also is a need for new and different lighting devices and methods for illuminating the interior of and/or the area surrounding spas, swimming pools, hot tubs, garden baths, and the like, and for lighting devices and methods for generating aesthetically pleasing light in, on and around spas, swimming pools, hot tubs, garden baths, and the like having a permanent or semi-permanent lighting base with covers and shades having different aesthetic designs and shapes whereby the spa, swimming pool, hot tub, garden bath, or the like can be customized by the owner.

Accordingly, there is a need for new and different lighting devices and methods for illuminating the exterior of and/or the area surrounding spas, swimming pools, hot tubs, garden baths, and the like, and for lighting devices and methods for generating aesthetically pleasing light on and around spas, swimming pools, hot tubs, garden baths, and the like. There also is a need for new and different lighting devices and methods for illuminating the exterior of and/or the area surrounding spas, swimming pools, hot tubs, garden baths, and the like, and for lighting devices and methods for generating aesthetically pleasing light on and around spas, swimming pools, hot tubs, garden baths, and the like having a permanent or semi-permanent lighting base with removable and replaceable covers and shades having different aesthetic designs and shapes. There is a further need for new and different lighting devices and methods for illuminating the exterior of and/or the area surrounding spas, swimming pools, hot tubs, garden baths, and the like, and for lighting devices and methods for generating aesthetically pleasing light on and around spas, swimming pools, hot tubs, garden baths, and the like having a permanent or semi-permanent lighting base with removable and replaceable covers and shades whereby the spa, swimming pool, hot tub, garden bath, or the like can be customized by the owner.

It is to these needs and others that the present invention is directed.

BRIEF SUMMARY OF THE INVENTION

Briefly described, the present invention is a clip for holding a light emitting device, which clip can be attached to a waterjet housing structure. The housing structure comprises a connector allowing the attachment of the clip to the housing structure. The housing structure itself is manufactured at least in part from a clear plastic or other material so as to allow the transmission of light therethrough. Further, additional components of the waterjet structure also preferably are manufactured from a clear plastic or other material also so as to allow the transmission of light therethrough.

The housing structure generally can be a typical or known housing structure, but having a specific housing connector for allowing the attachment of the clip and being manufactured at least in part from a clear material. For example, the barrel of the housing into which the waterjet nozzle is placed can have the housing connector configured thereon such that the light emitting device can emit light directly through the housing, which light then can be transmitted through the waterjet, the waterjet nozzle, and/or through the housing into the spa. A T-shaped housing connector or a +-shaped housing connector are representative housing connector shapes. The nozzle structure also can be a typical or known nozzle structure, but preferably also being manufactured from a clear material to allow the transmission of the light therethrough.

The clip comprises a structure for containing and/or supporting the light emitting device and a clip connector for attaching the clip to the housing. The structure for containing and/or supporting the light emitting device can be of various sizes and shapes depending on the desired light emitting device. For example, a relatively small cylindrical structure can be used for LEDs and mini-bulbs while a relatively large structure can be used for more conventional or older bulbs. The clip connector for attaching the clip to the housing can be structured to cooperate with the housing connector on the housing, or can be a spring clip or other connectorless connection device.

In a first embodiment of the light clip, the light clip comprises a tubular structure for containing and/or supporting the light source and a connector for attaching the light clip to the light clip connector, with the tubular structure extending generally parallel to the connector. In a second embodiment of the light clip, the light clip is for holding a light source onto other types of spa features, such as spa lights, spa controls, and lighted cup holders. In the second embodiment, the light clip also comprises a tubular structure for containing and/or supporting the light source and a connector for attaching the light clip to the light clip connector, with the tubular structure extending at an angle from the connector, rather than lying parallel to the connector. The connector for attaching the light clip to the light clip connector can be structured to cooperate with the light clip connector on the housing, or can be a spring clip or a connectorless connection device. When the light clip is attached to the light clip connector, the light source is in a position to provide light to the spa feature.

Thus, the invention generally is a clip device that can be installed on a waterjet to provide for the addition of aesthetically pleasing and decorative light to a spa by allowing light to be transmitted through a clear waterjet body and in turn through clear nozzles and or jet faces. The device also can be used to provide illumination of or through valve handles or any other controls when a clear bezel is installed on the control. In the invention, light is transmitted through the waterjet, such as through the housing and/or through the nozzle structure, to the spa. Thus, the spa user can be presented with illuminated waterjets. Additionally, in the invention, water from a water source flows into the waterjet where it is illuminated before passing out of the waterjet to form a water stream that is introduced into the spa. Because the water flowing through the waterjet typically has air bubbles entrained therein, the air bubbles refract the light differently than the water and can also appear to be illuminated when being injected into the body of water already in the spa.

The clip can be attached to the housing on the dry side of the spa. In a preferred embodiment, the device can be installed with a minimum of disturbance to the surrounding spa as opposed to typical fountain devices that may require complex cuts and accompanying high costs of installation. The present invention is therefore also is much less costly to install than other lighting devices. The device can be used on almost any artificial water body. While the device is described in connection with a spa, it is understood that the device can be used on spas, swimming pools, tubs, and the like. One of ordinary skill in the art can modify the device without undue experimentation so that it can be placed on almost any artificial water body.

These features, and other features and advantages of the present invention will become more apparent to those of ordinary skill in the relevant art when the following detailed description of the preferred embodiments is read in conjunction with the appended drawings in which like reference numerals represent like components throughout the several views.

DETAILED DESCRIPTION OF PREFERRED EMBODIMENTS

Figure 1:
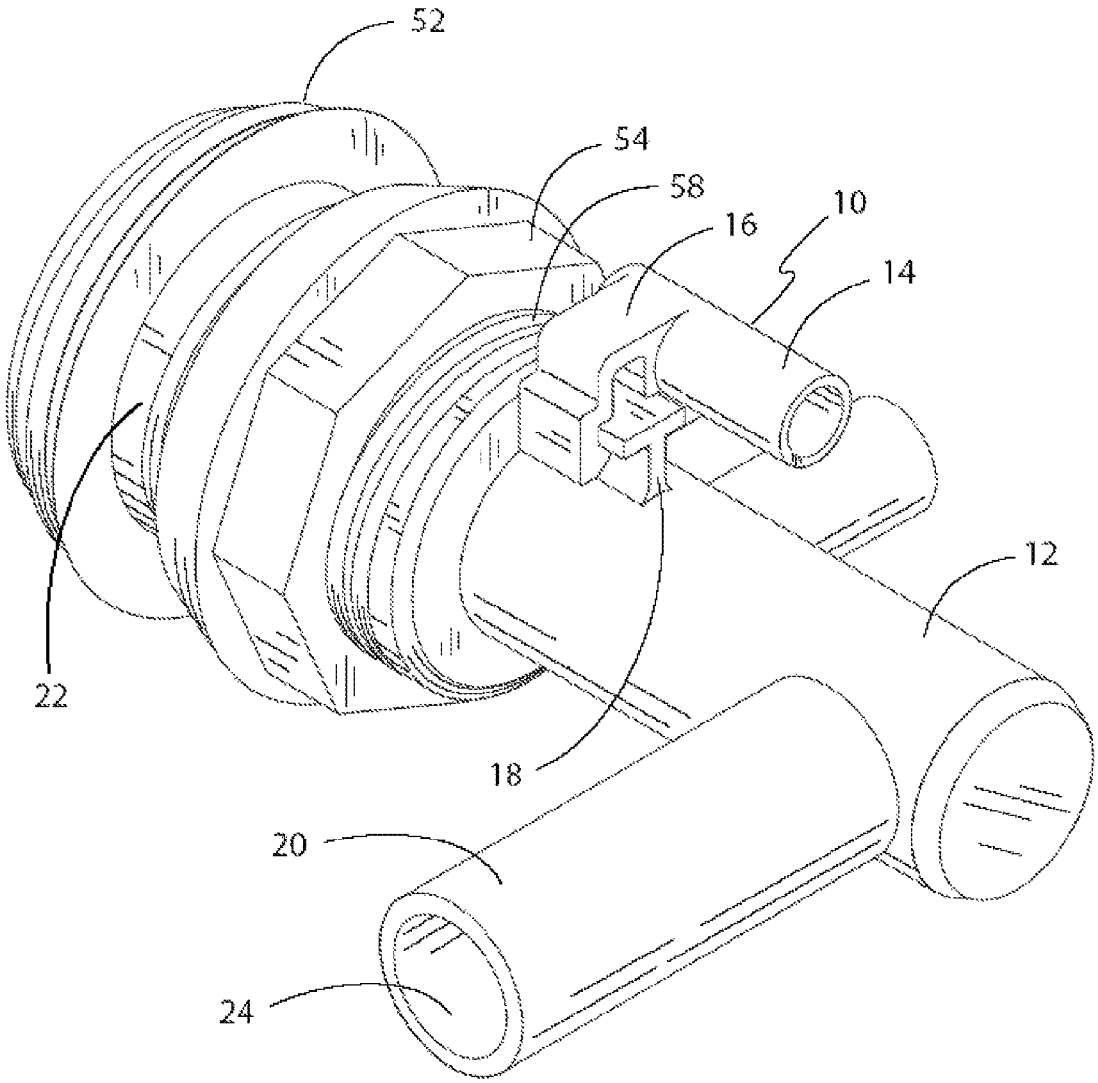
FIG. 1 is a first perspective view of one embodiment of the present invention showing a clip attached to a clear housing.
Figure 2:
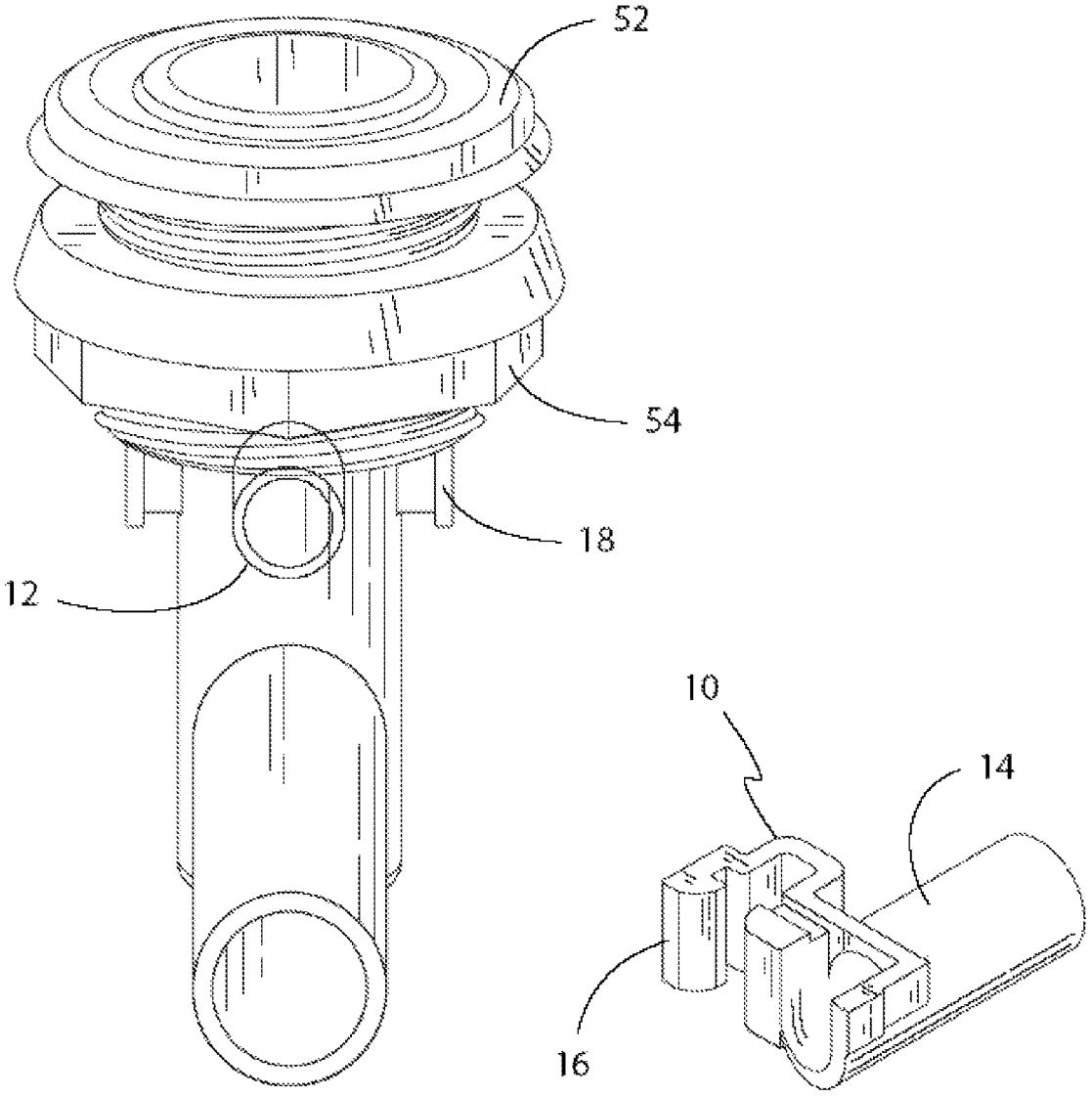
FIG. 2 is a perspective view of one embodiment of the present invention showing a clip removed from to a clear housing.

Illustrative embodiments of the present invention are shown in FIGS. 1 through 9. FIGS. 1 and 2 are perspective view of one embodiment the present invention showing a clip 10 attached to a clear housing 12 and a clip 10 removed from a clear housing 12, respectively. As can be seen, the invention is a simple and effective device for providing illumination to a waterjet housing 12 and/or to a stream of water flowing through the waterjet housing 12.

Figure 3:
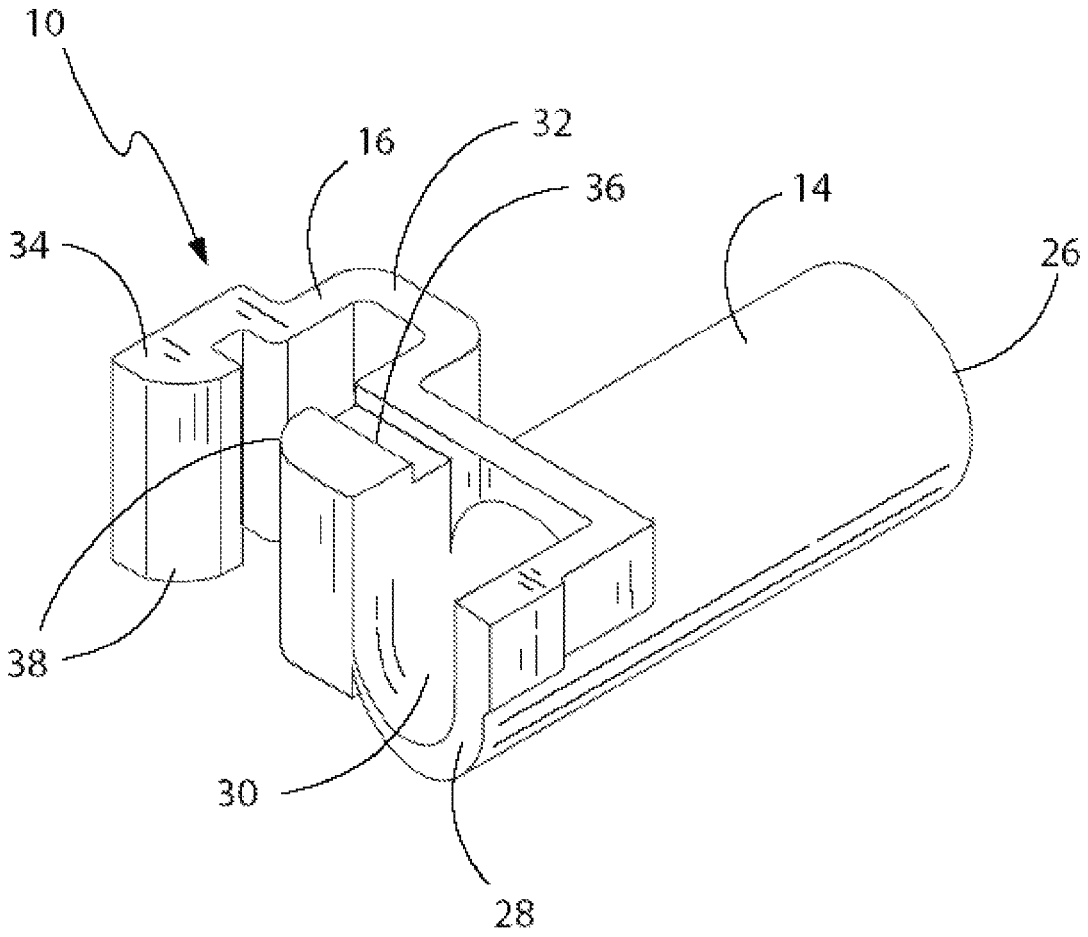
FIG. 3 is a perspective view of one embodiment of a clip according to the present invention.
Figure 4:
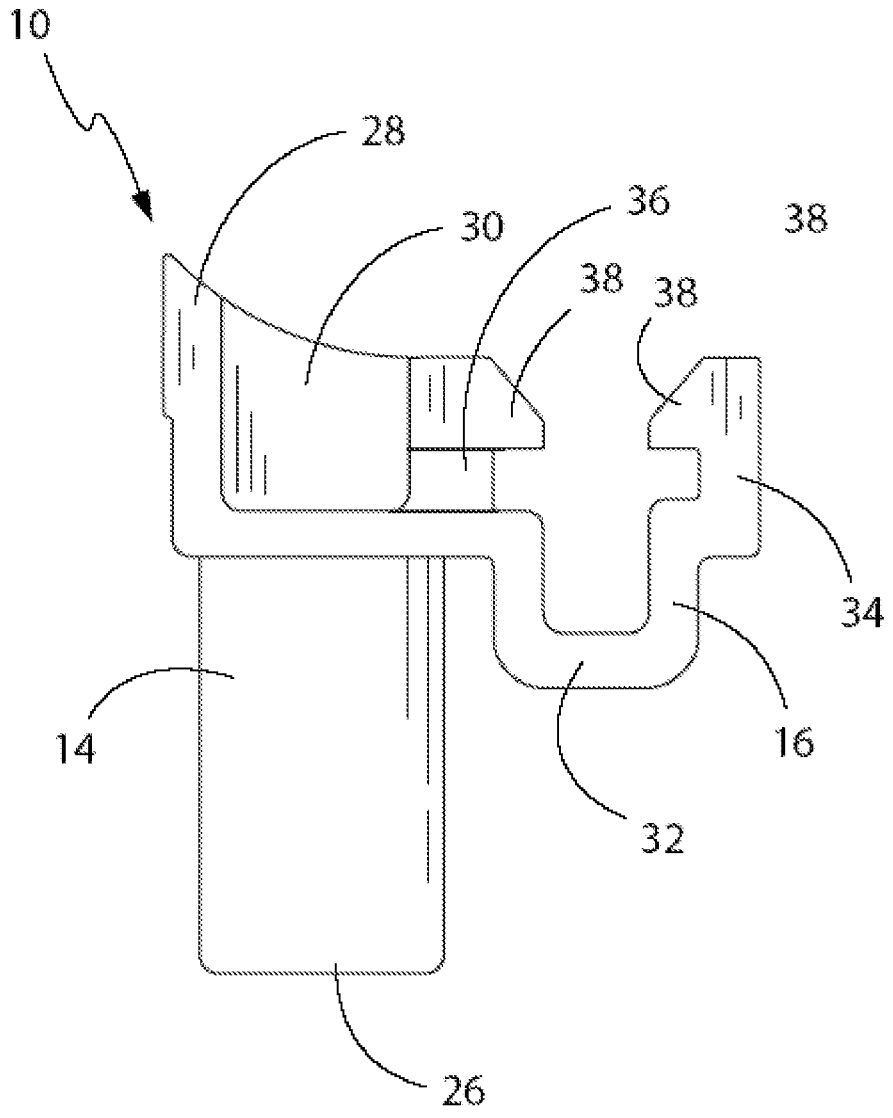
FIG. 4 is a side view of one embodiment of a clip according to the present invention.

FIG. 3 is a perspective view of one embodiment of a clip 10 according to the present invention and FIG. 4 is a side view of one embodiment of a clip 10 according to the present invention in which the light emitting device support 14 and the clip connector 16 are show in detail. While the support 14 and the clip connector 16 are shown in a roughly parallel configuration, other embodiments of the device also allow for the support 14 and the clip connector 16 to be in a perpendicular configuration, or at other angles to each other.

Figure 5:
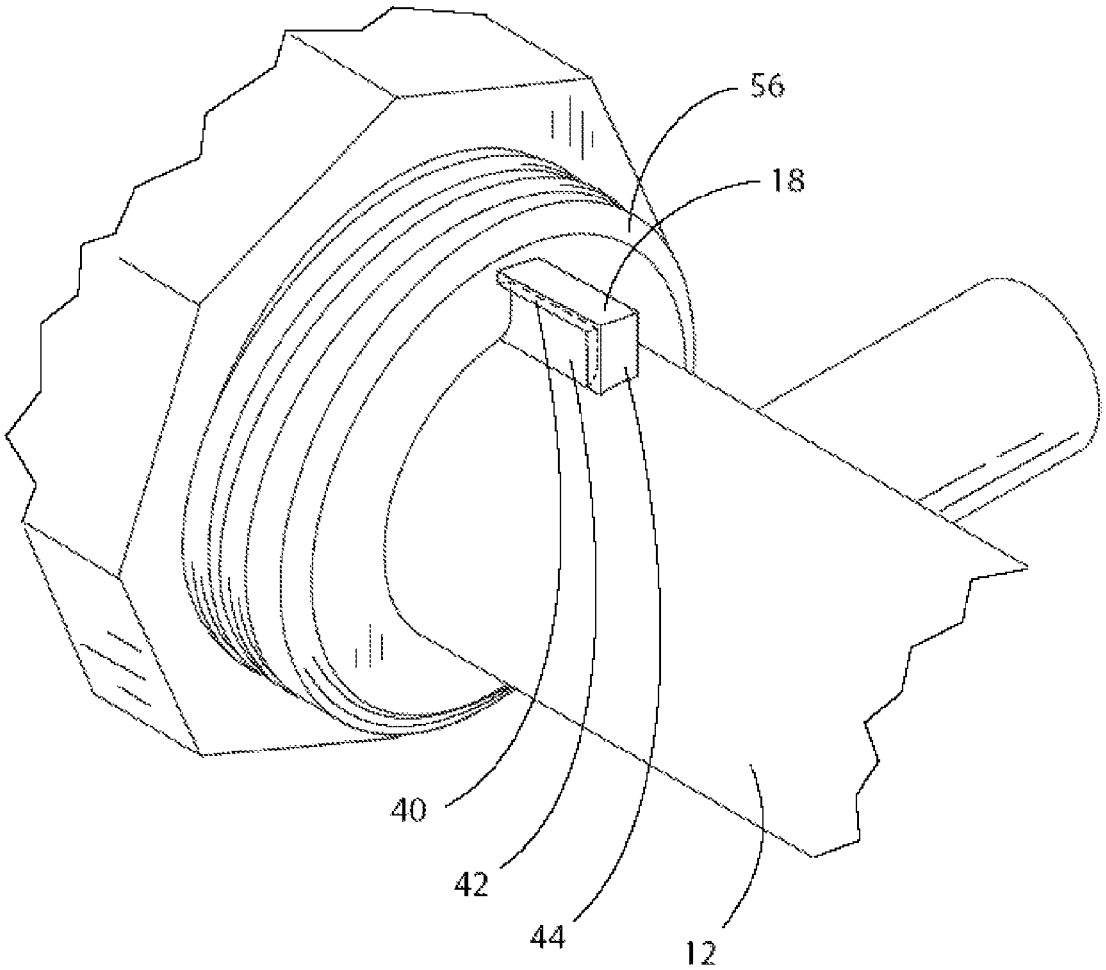
FIG. 5 is a perspective side view of one embodiment of a housing connector according to the present invention.
Figure 5A:
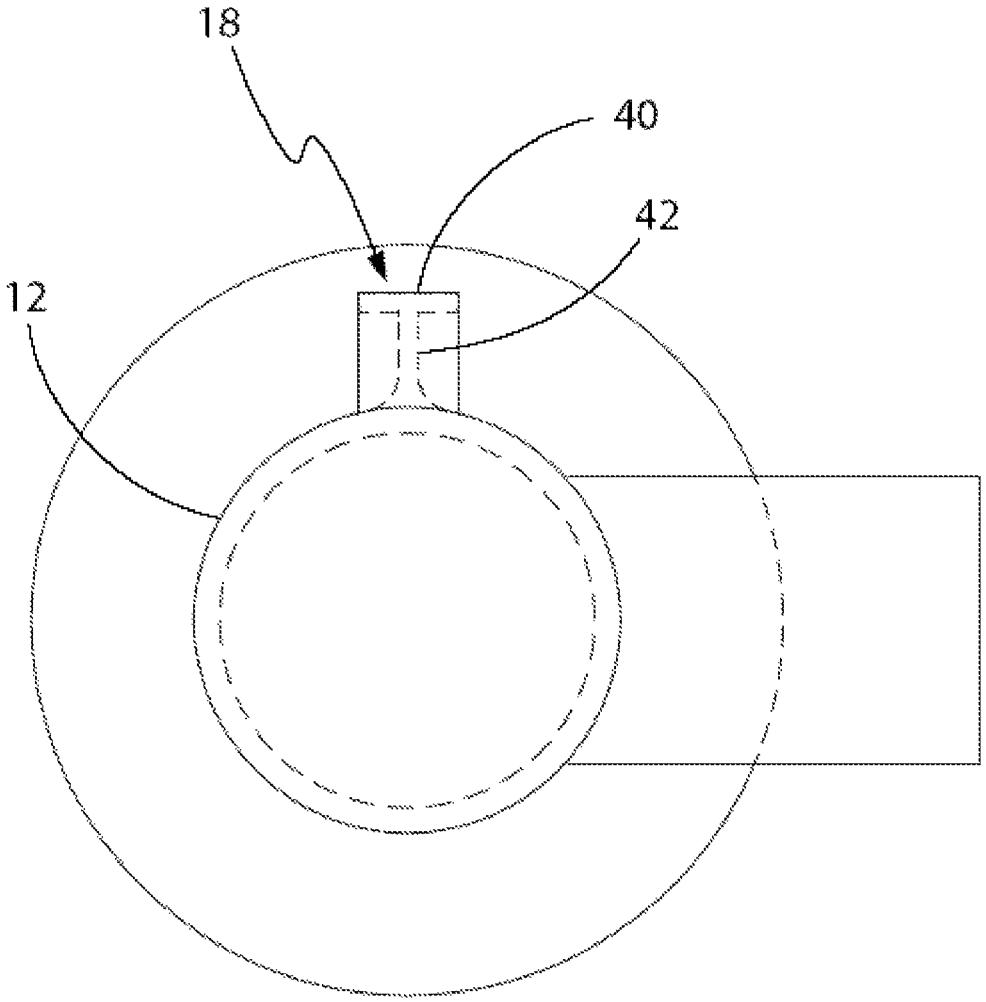
FIG. 5A is an end view of the embodiment of a housing connector as shown in FIG. 5.
Figure 5B:
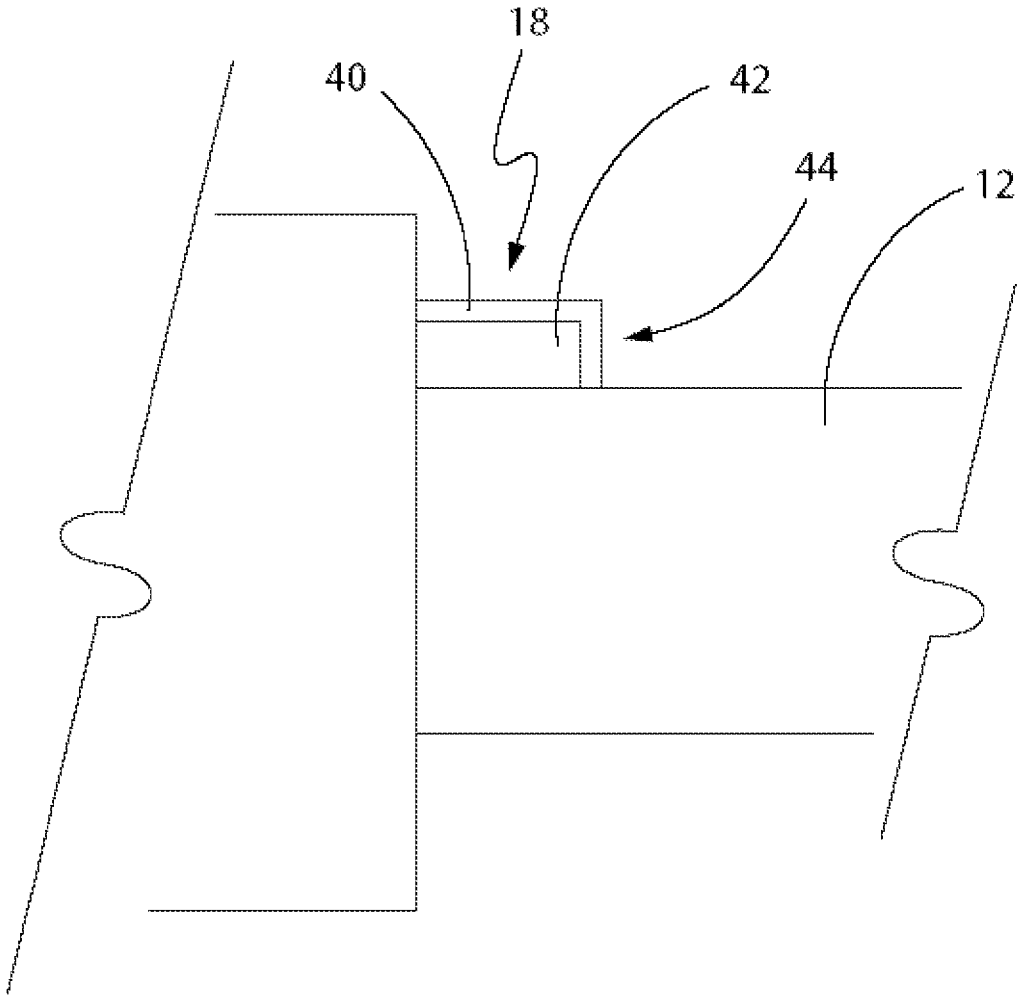
FIG. 5B is a side view of the embodiment of a housing connector as shown in FIG. 5.
Figure 5C:
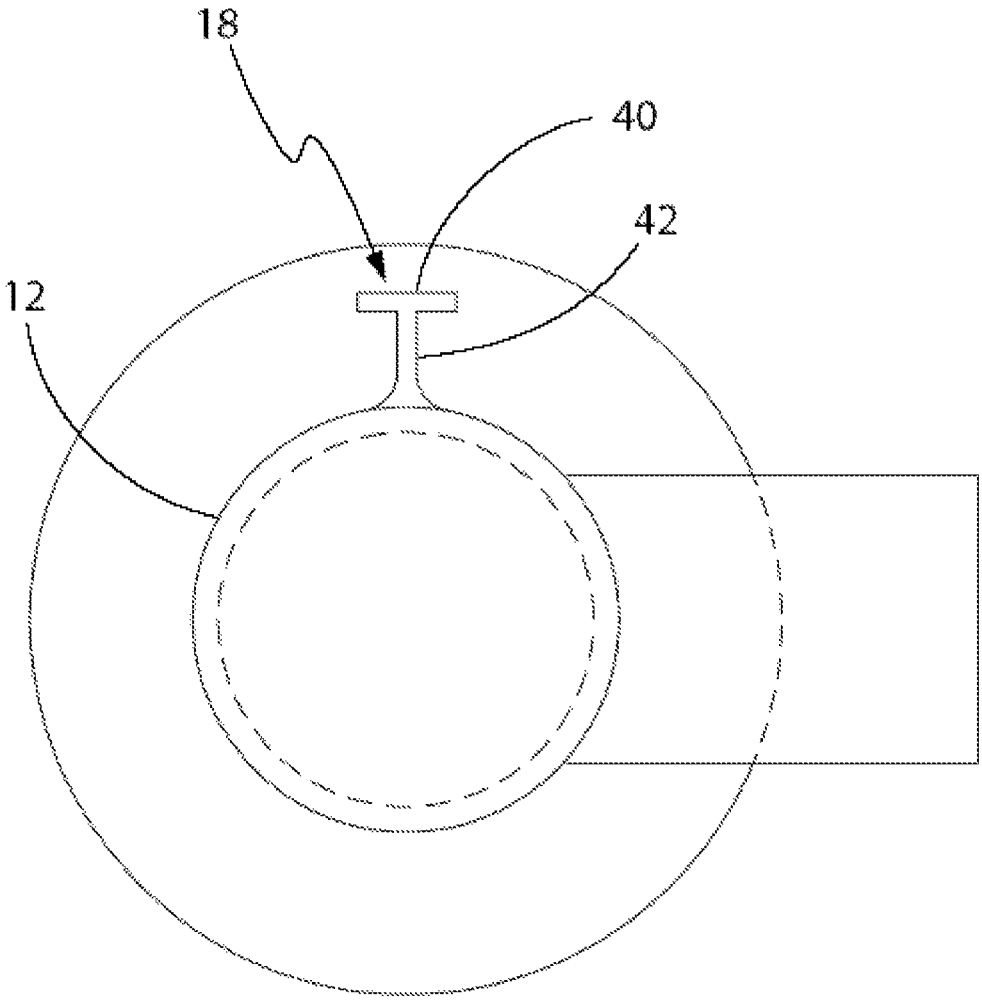
FIG. 5C is an end view of another embodiment of a housing connector according to the present invention.
Figure 5D:
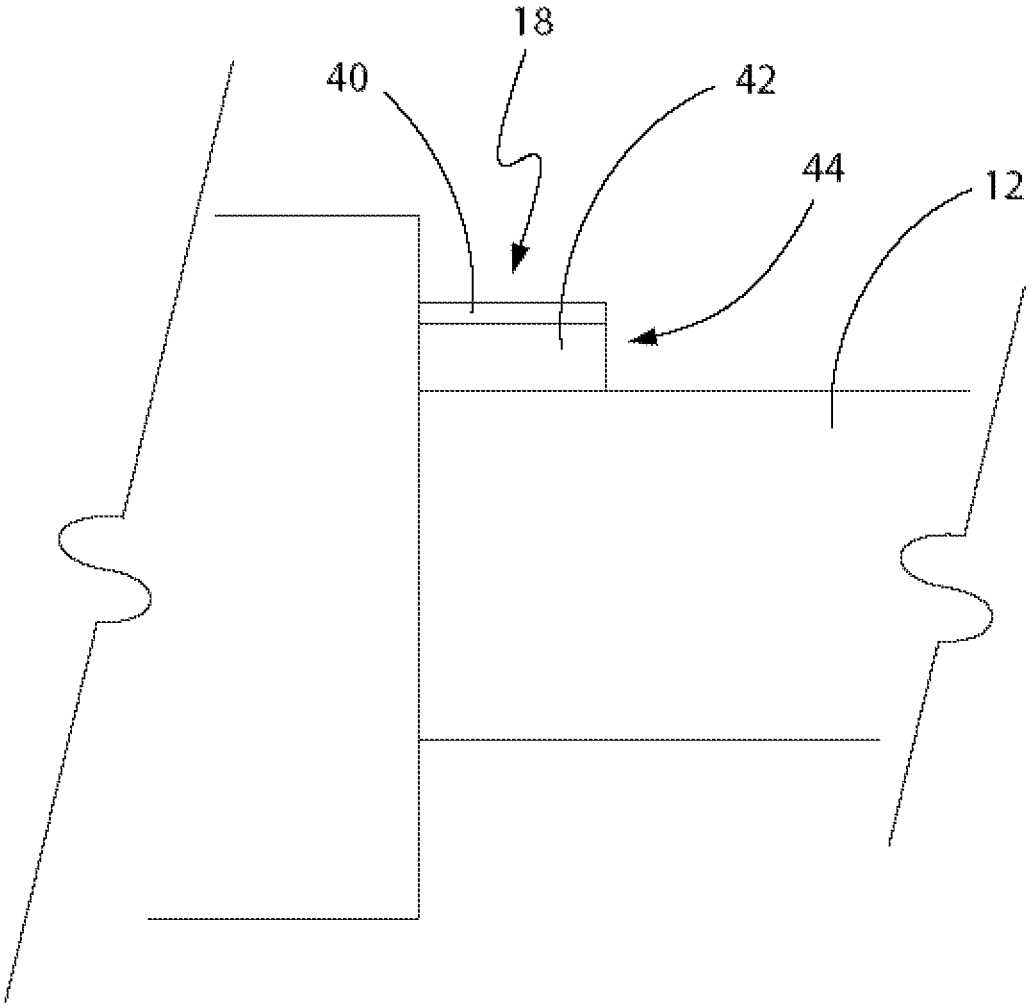
FIG. 5D is a side view of the embodiment of a housing connector as shown in FIG. 5C.

FIG. 5 is a side view of one embodiment of a housing connector 18 according to the present invention. The housing connector 18 and the clip connector 16 cooperate with each other to allow for simple yet secure connection of the clip 10 to the housing 12, and for the removal of the clip 10 from the housing 12. FIG. 5A is an end view of the embodiment of a housing connector as shown in FIG. 5. FIG. 5B is a side view of the embodiment of a housing connector as shown in FIG. 5. FIG. 5C is an end view of another embodiment of a housing connector according to the present invention. FIG. 5D is a side view of the embodiment of a housing connector as shown in FIG. 5C.

Figure 6:
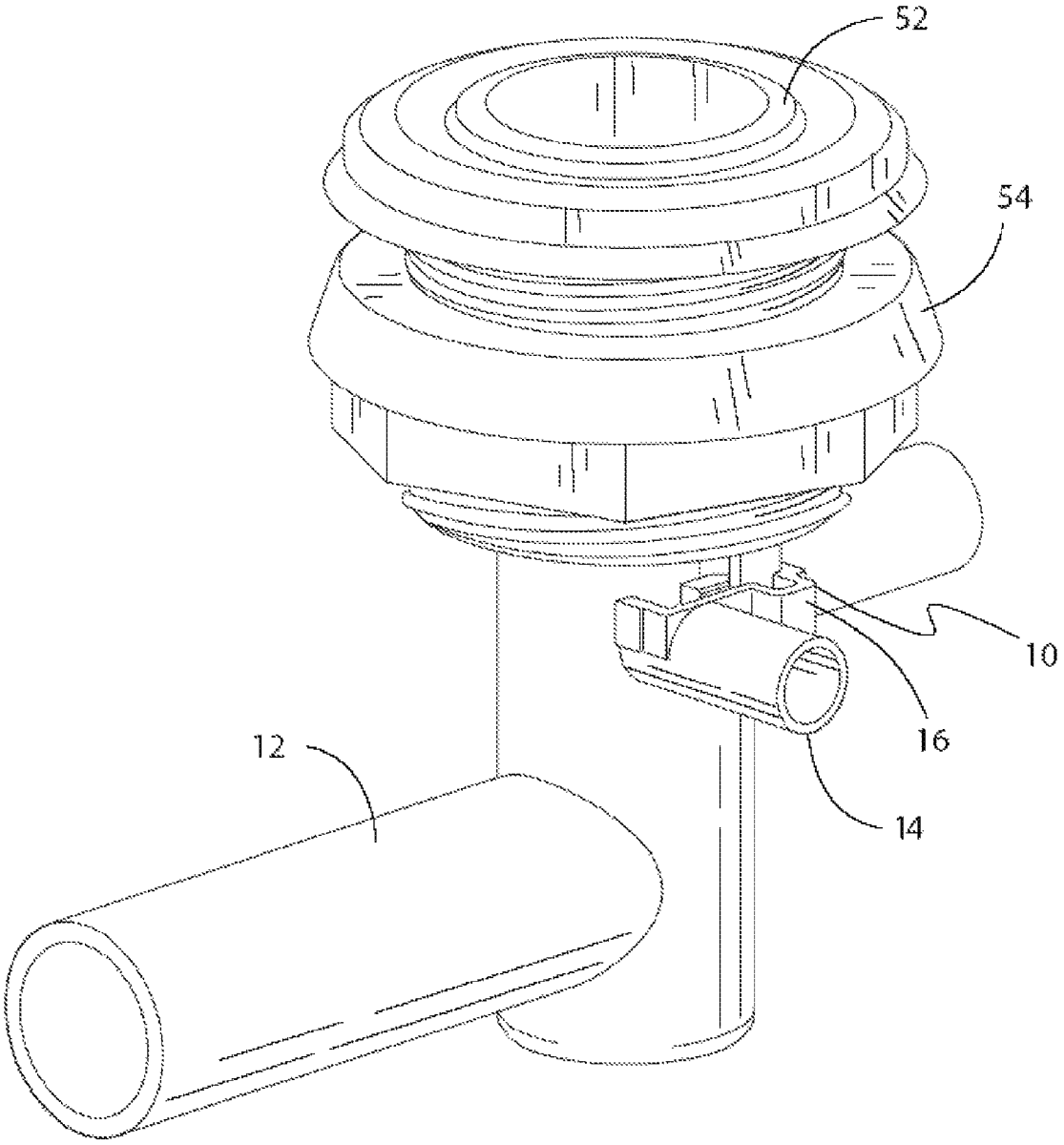
FIG. 6 is a second perspective view of one embodiment of the present invention showing a clip attached to a clear housing.
Figure 7:
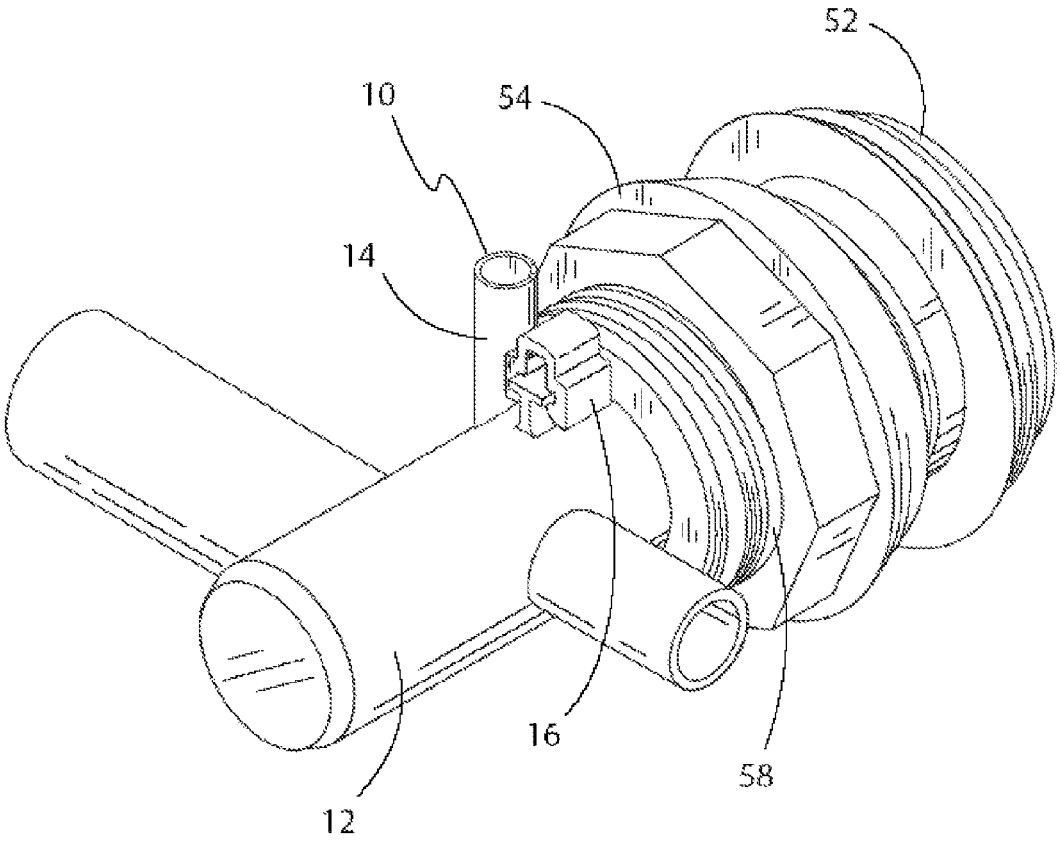
FIG. 7 is a side view of one embodiment of the present invention showing a clip attached to a clear housing.
Figure 8:
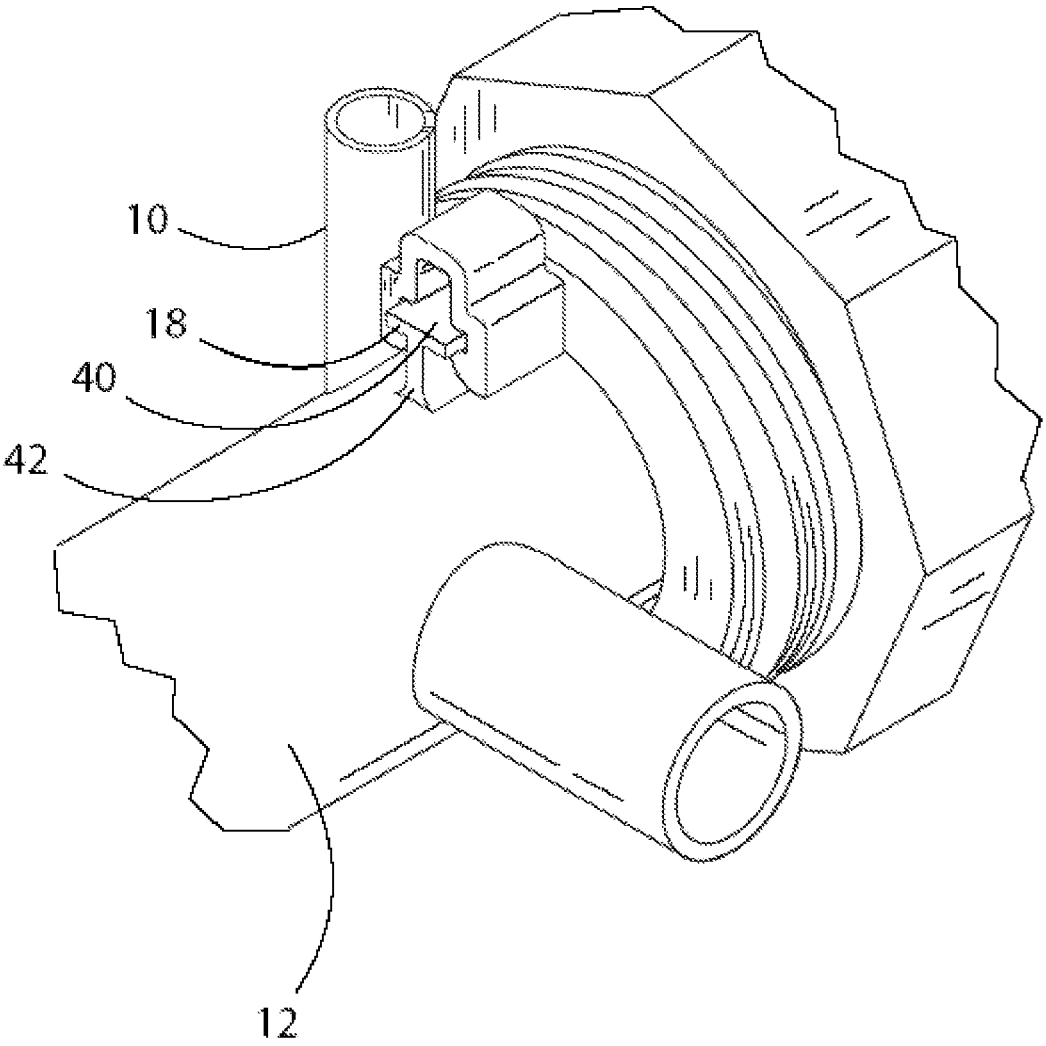
FIG. 8 is an end view of one embodiment of the present invention showing a clip attached to a clear housing.
Figure 9:
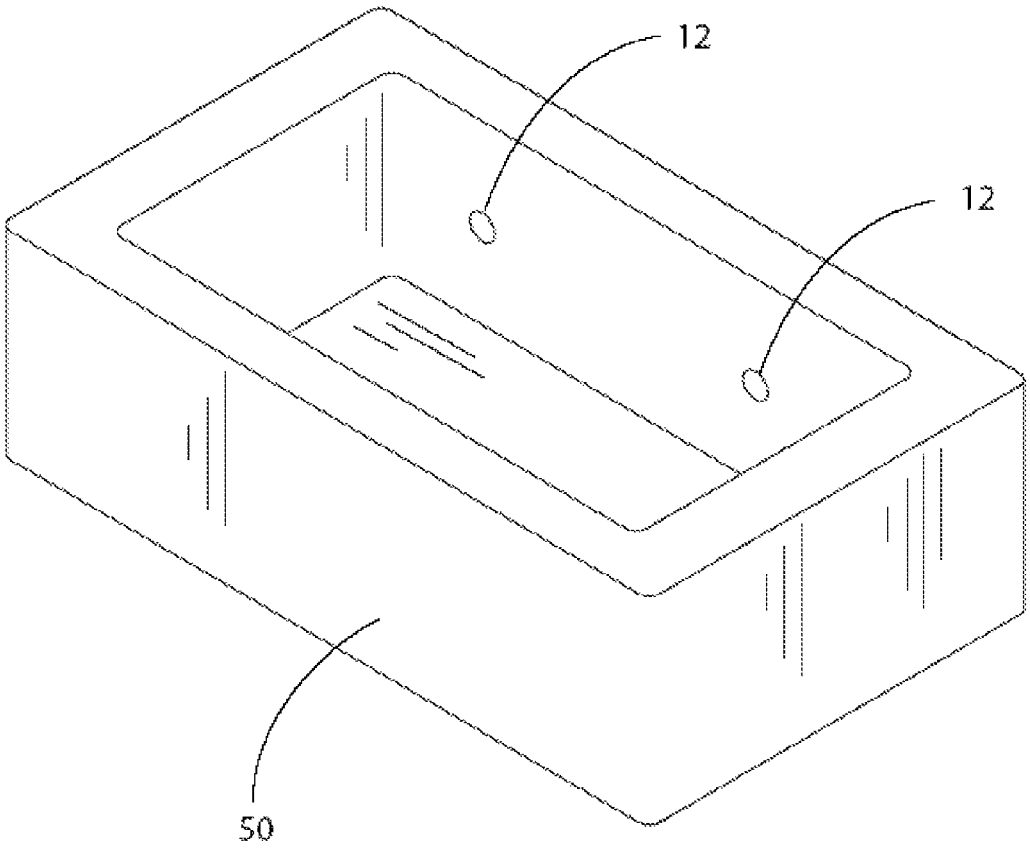
FIG. 9 is a view of a spa incorporating the present invention.

FIGS. 6 through 8 are views from various angles showing an illustrative embodiment of the present invention showing a clip 10 attached to a clear housing 12, and FIG. 9 is a view of a spa 50 incorporating the present invention. As can be seen, the clip 10 allows for light to be directed at the clear housing 12 such that the housing 12 can be illuminated, and the illumination can be seen in the spa 50.

Figure 10:
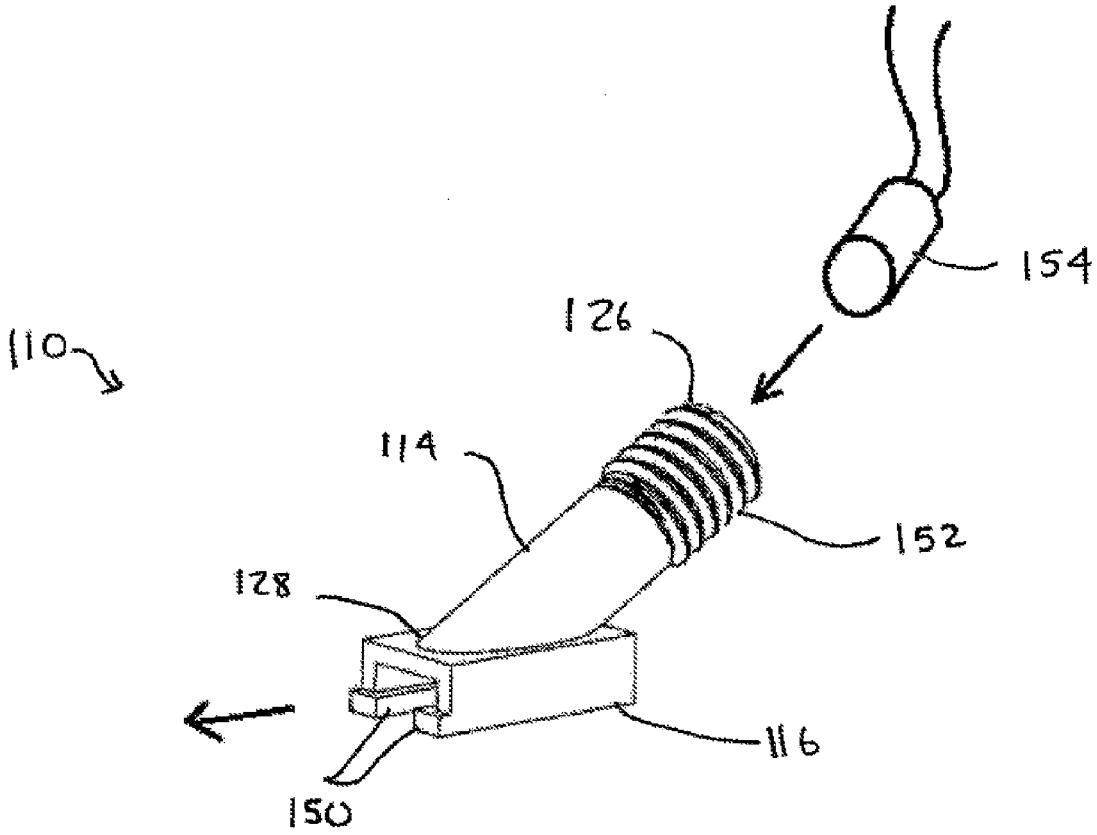
FIG. 10 is a perspective view of a second embodiment of a clip according to the present invention showing a light source.
Figure 11:
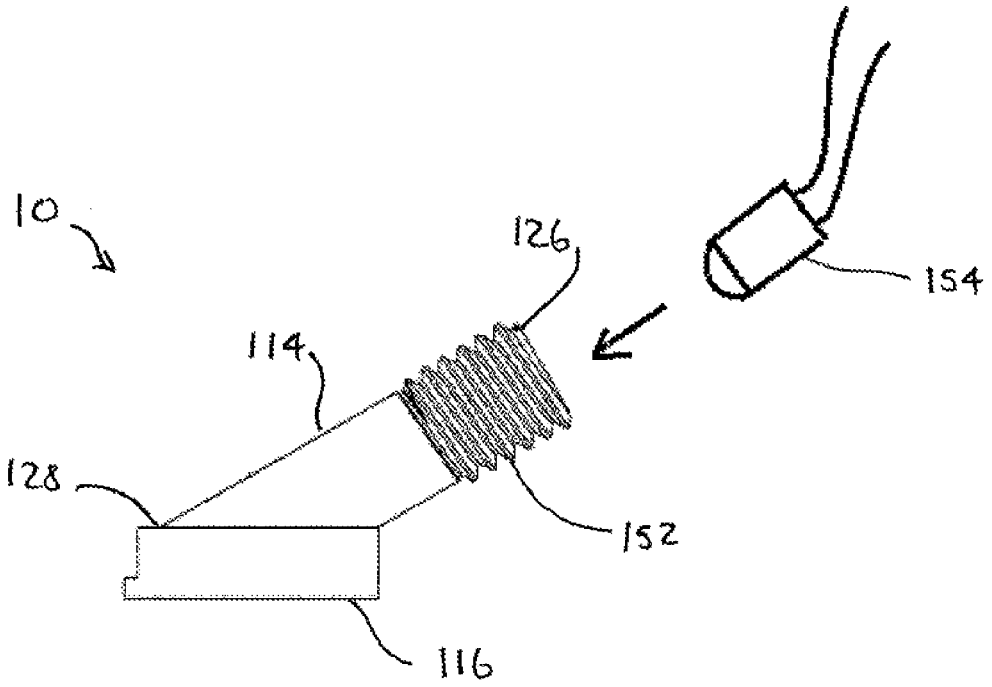
FIG. 11 is a side view of the second embodiment of a clip according to the present invention with a light source.
Figure 12:
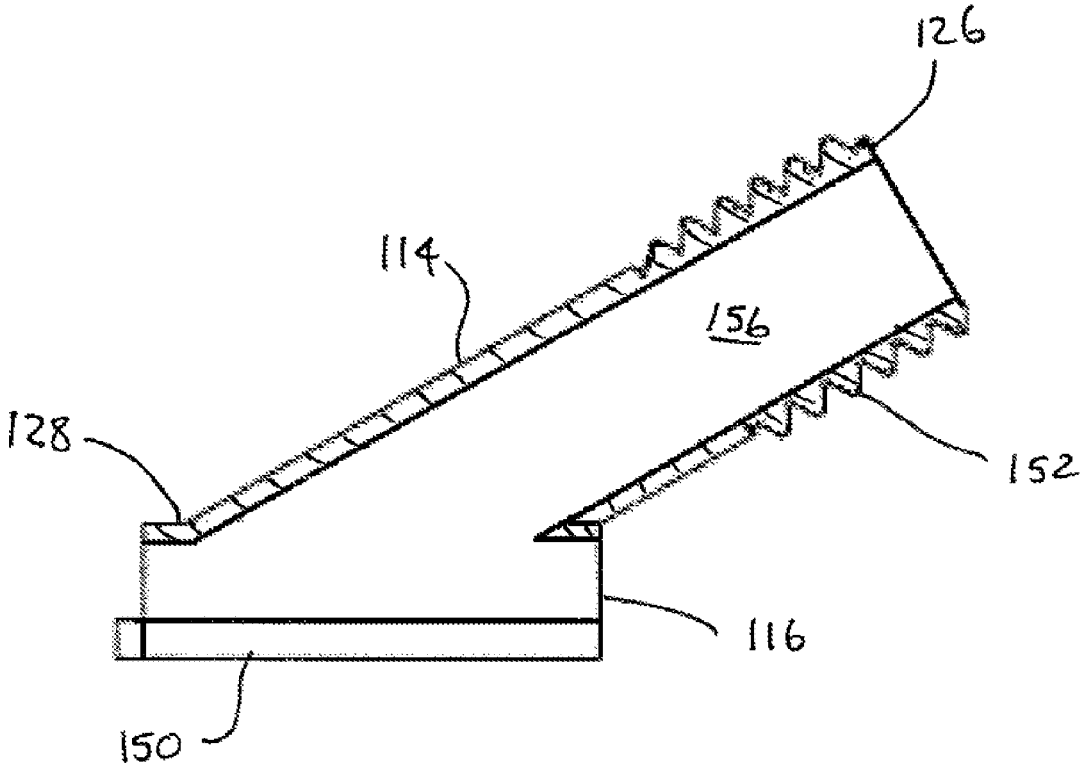
FIG. 12 is a cross sectional side view of the second embodiment of a clip according to the present invention.
Figure 13:
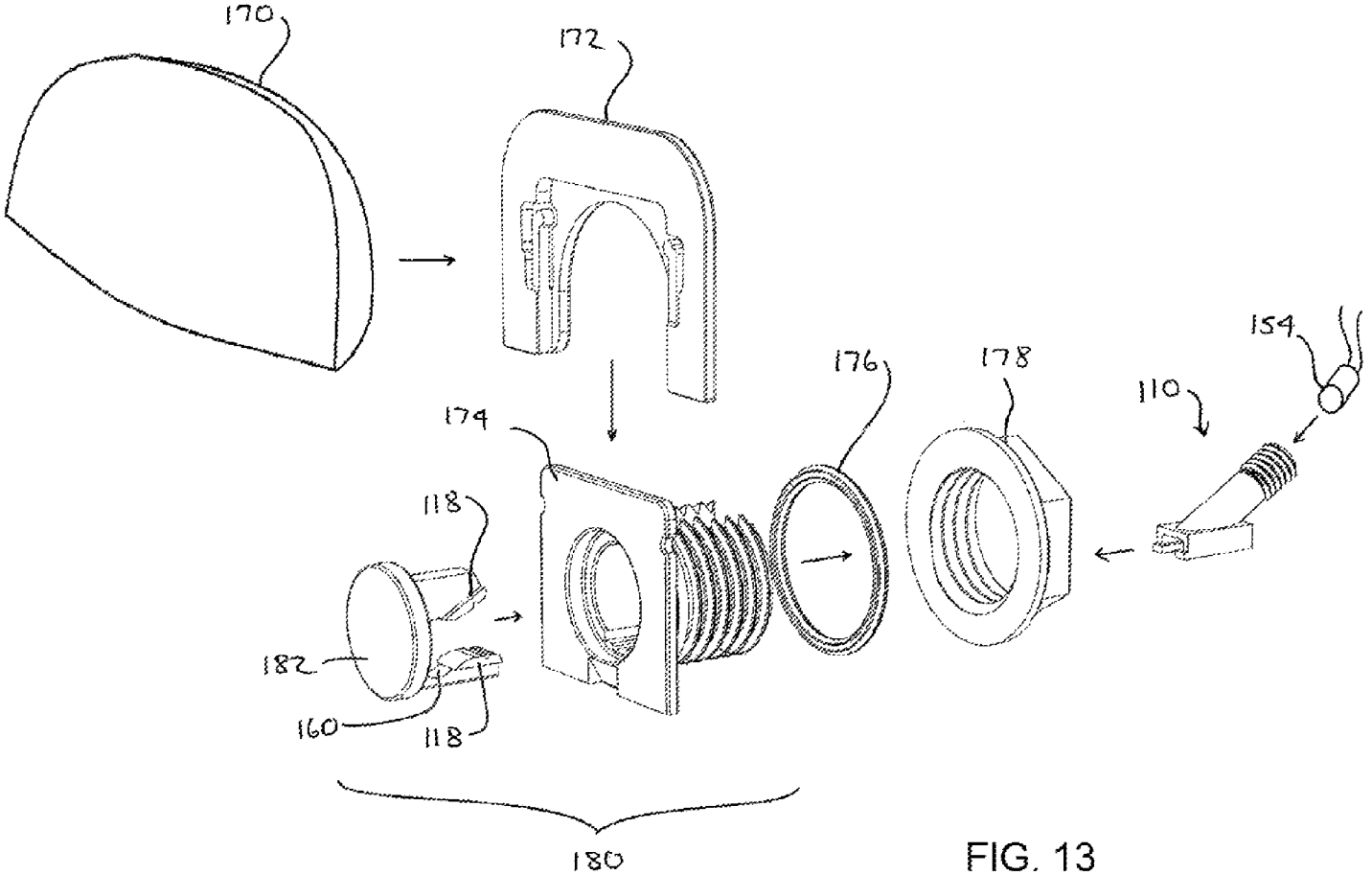
FIG. 13 is an exploded perspective view of a spa feature showing a use of a clip according to the second embodiment of the invention.
Figure 14:
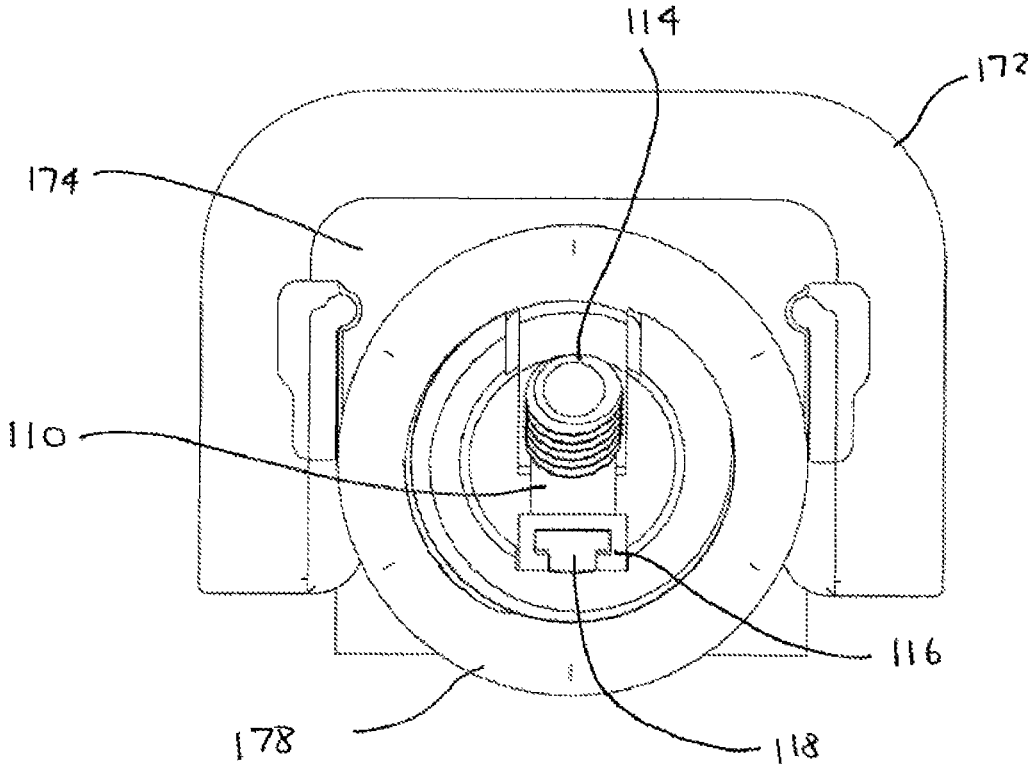
FIG. 14 is a rear view of a spa feature showing a use of a clip according to the second embodiment of the invention.
Figure 15:
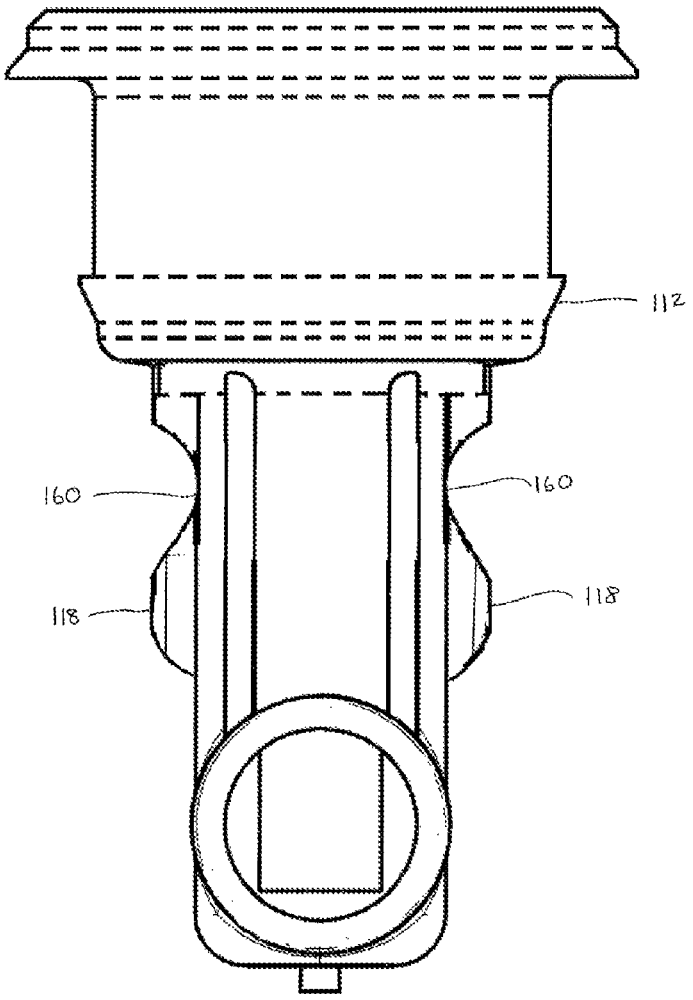
FIG. 15 is a bottom view of a waterjet showing a housing connector suitable for use with a clip according to the second embodiment of the invention.
Figure 16:
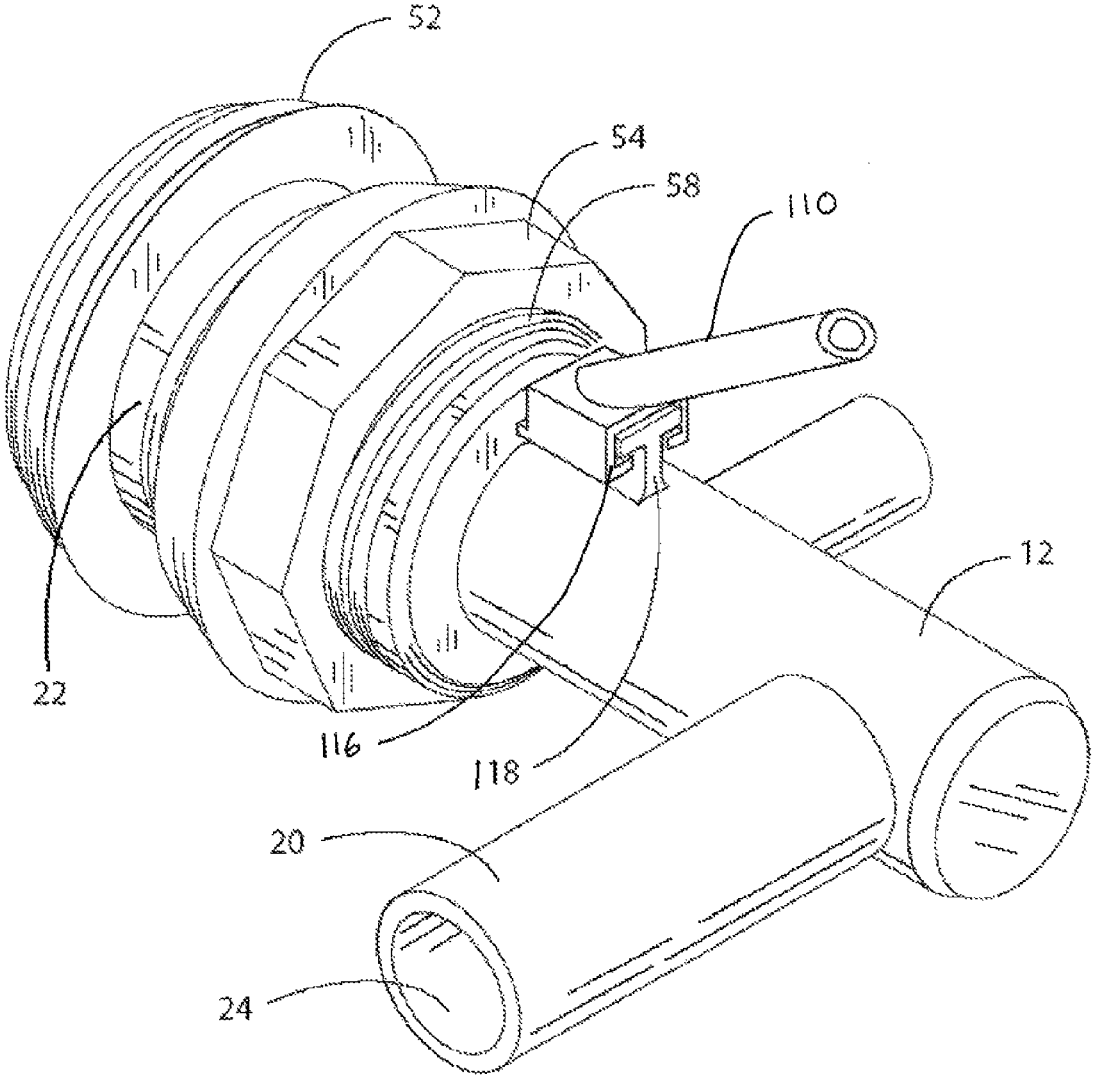
FIG. 16 is a perspective view showing a clip according to the second embodiment of the invention mounted on a waterjet.

FIGS. 10-16 are views showing a second embodiment of the clip of the present invention. FIG. 10 is a perspective view and FIG. 11 is a side view of the second embodiment of a clip according to the present invention with a light source. FIG. 12 is a cross sectional side view of the second embodiment of a clip according to the present invention. FIG. 13 is an exploded perspective view of a spa feature, namely a bulkhead light fitting, showing a use of a clip according to the second embodiment of the invention. FIG. 14 is a rear view of a spa feature, namely a bulkhead light fitting, showing a use of a clip according to the second embodiment of the invention. FIG. 15 is a bottom view of a waterjet showing a housing connector suitable for use with a clip according to the second embodiment of the invention. FIG. 16 is a perspective view showing a clip 110 according to the second embodiment of the invention mounted on a waterjet 12.

FIG. 1 illustrates an embodiment of the clip 10 for holding a light emitting device (not shown, but to be located within support 14), which clip 10 is attached to a waterjet housing 12 structure. FIG. 2 illustrates the clip 10 disconnected from the housing 12. The housing 12 comprises a housing connector 18 allowing the attachment of the clip 10 to the housing 12. Housing 12 preferably comprises a substantially hollow form capable of holding and supporting the waterjet body and nozzle (not shown) therein. Housing 12 may be formed of any suitable material, including, but not limited to, plastic, wood, ceramic, or stainless steel. Housing 12 generally has a first end 20 and a second end 22. As disclosed herein, the first end 20 may be interchangeably referred to as the lower end and the second end 22 may be interchangeably referred to as the upper end.

Housing 12 may contain a first opening 24 towards the first end 20 of the housing 12. First opening 24 provides a space for a pipe, hose, or other water supply (not pictured) to enter into housing 12. The pipe or other water supply may be configured to mate with first opening 24. Preferably, the outer diameter of the pipe or other water supply will be just slightly less than or equal to the inside diameter of first opening 24, thus allowing the pipe to snugly fit inside the first opening 24. This allows water to be provided to the waterjet. Second end 22 is located in the spa (or proximal to the spa if the jet is not located in the spa body) and contains the waterjet. Water emanates from the second end 22 for introduction into the spa 50. It is the second end 22 through which the light shines so as to illuminate the housing 12 or to add illumination to the stream of water introduced to the spa 50. The general structure of housing 12 shown in the figures is more or less known in the industry.

The housing 12 further comprises a specific housing connector 18 for allowing the attachment of the clip 10 and being manufactured at least in part from a clear material. For example, the barrel of the housing 12 into which the waterjet nozzle is placed can have the housing connector 18 configured thereon such that the light emitting device can emit light directly through the housing 12, which light then can be transmitted through the waterjet, the waterjet nozzle, and/or through the housing 12 into the spa 50. A T-shaped or a +-shaped housing connector 18 are representative housing connector 18 shapes. The exact shape of housing connector 18 should match and cooperate with the shape of the clip connector 16 as disclosed herein. In a preferred embodiment shown in the figures, housing connector 18 is a T-shaped structure attached to and extending radially outward from the housing 12

FIGS. 3 and 4 illustrate a preferred embodiment of clip 10 in more detail. The clip 10 comprises support 14 for containing and/or supporting the light emitting device (not shown) and clip connector 16 for attaching the clip 10 to the housing 12. The support 14 can be of various sizes and shapes depending on the desired light emitting device. For example, a relatively small cylindrical structure can be used for LEDs and mini-bulbs while a relatively large structure can be used for more conventional or older bulbs.

Support 14 is shown as a cylindrical body in a roughly parallel configuration relative to clip connector 16. Support 14 is structure to contain the light emitting device and to allow any of the necessary wires, batteries, or other means for supplying electricity or other power to the light emitting device. Support 14 can be a cup-like structure having a closed bottom 26 and an open top 28. Alternatively, bottom 26 can be open. Top 28 can be configured to rest snugly against housing 12 such that light from the light emitting device is more efficiently provided to housing 12. With a closed bottom 26, wires for providing electricity to the light emitting device can extend through notch 30. With an open bottom 26, wires may alternatively extend through bottom 26. Other embodiments of the device also allow for the support 14 and the clip connector 16 to be in a perpendicular configuration, or at other angles to each other.

Clip connector 16 for attaching the clip 10 to the housing 12 can be structured to cooperate with the housing connector 18 on the housing 12, or can be a spring clip or other connectorless connection device. As shown, clip connector 16 is structured to cooperate with the T-shaped housing connector 18 shown on housing 12. Arch 32 allows arm 34 to flex towards and away from base 36 such that clip connector 16 can snap onto housing connector 18. Angled mouth 38 allows arm 34 to flex away from base 36 when mouth 38 is pressed against housing connector 18, and specifically against the sides of the flat top 40 portion of housing connector 18. In this way, clip 10 can be securely snapped onto housing connector 18. To remove clip 10 from housing connector 18, one can pull outward on arm 34, thus disengaging arm 34 from housing connector 18.

FIG. 5 is a side view of one embodiment of a housing connector 18 according to the present invention. The housing connector 18 and the clip connector 16 cooperate with each other to allow for simple yet secure connection of the clip 10 to the housing 12, and for the removal of the clip 10 from the housing 12. As can be seen in FIGS. 5 and 8, T-shaped housing connector 18 comprises flat top 40 and stem 42. Stem 42 is connected to and extends radially from housing 12. Flat top 40 extends perpendicular to stem 42. This configuration allows clip 10 to be snapped onto housing connector 18 as disclosed herein. Flat end 44 prevents clip 10 from sliding off of housing connector 18. FIG. 5A is an end view of the embodiment of a housing connector 18 as shown in FIG. 5 and FIG. 5B is a side view of the embodiment of a housing connector 18 as shown in FIG. 5.

FIG. 5C is an end view of another embodiment of a housing connector 18 according to the present invention not having a flat end 44. FIG. 5D is a side view of the embodiment of a housing connector 18 as shown in FIG. 5C. In this embodiment, as flat end 44 is not present, clip 10 can be slid onto and off of housing connector from the end of housing connector 18 where flat end 44 is not present.

FIGS. 6 through 8 are views from various angles showing an illustrative embodiment of the present invention showing a clip 10 attached to a clear housing 12. As can be seen, the clip 10 allows for light to be directed at the clear housing 12 such that the housing 12 can be illuminated, and the illumination to be seen in the spa 50. In these views, clip connector 16 cooperates with housing connector 18 to securely but removably hold clip 10 onto housing 12. In the preferred configuration, top 28 contacts housing 12 so as to best position the light emitting device relative to housing 12.

Thus, the invention generally is a clip 10 that can be installed on a waterjet to provide for the addition of aesthetically pleasing and decorative light to a spa 50 by allowing light to be transmitted through a clear waterjet housing 12 and in turn through clear nozzles and or jet body flange 52. For example, the clip 10 also can be used to provide illumination of or through valve handles or any other controls when a clear bezel is installed on the control. In the invention, light is transmitted through the waterjet, such as through the housing 12 and/or through the nozzle structure and/or the jet body flange 52, to the spa 50. Thus, the spa user can be presented with illuminated waterjets. Additionally, in the invention, water from a water source can flow into the waterjet where it can be illuminated before passing out of the waterjet to form a water stream that is introduced into the spa 50. Because the water flowing through the waterjet typically has air bubbles entrained therein, the air bubbles refract the light differently than the water and can also appear to be illuminated when being injected into the body of water already in the spa 50.

The clip 10 can be attached to the housing 12 on the dry side of the spa. In a preferred embodiment, the clip 10 can be installed with a minimum of disturbance to the surrounding spa 50 as opposed to typical fountain devices that may require complex cuts and accompanying high costs of installation. The present invention is therefore also can be much less costly to install than other lighting devices. The clip 10 can be used on almost any artificial water body. While the clip 10 is described in connection with a spa, it is understood that the clip 10 can be used on spas, swimming pools, tubs, and the like. One of ordinary skill in the art can modify the device without undue experimentation so that it can be placed on almost any artificial water body.

FIG. 9 illustrates a simple spa 50 showing simple placement of waterjets. The housing 12 is inserted into a hole formed into spa surface until the jet body flange 52 contacts the spa surface. The hole formed into spa surface should be of a size and shape so as to cooperate with the size and shape of housing 12. Once the housing 12 is inserted into the hole, a mounting nut 54 is slid over the housing 12 and screwed onto threads 56 on the housing 12 and tightened against spa surface, sandwiching the spa surface between the mounting nut 54 and the jet body flange 52, thus securing the housing 12 onto spa surface.

FIG. 10 is a perspective view of a second embodiment of the clip 110 according to the present invention showing a light source 154. FIG. 11 is a side view of the second embodiment of a clip 110 according to the present invention with a light source 154. FIG. 12 is a cross sectional side view of the second embodiment of a clip 110 according to the present invention. The clip 110 is for holding a light source 154, such as a light emitting diode (LED) or other light emitting device, and can be attached to a housing connector 118. The clip 110 comprises a tubular structure 114 for containing and/or supporting the light source 154 and a connector 116 for attaching the clip 110 to the housing connector 118. Clip 110 is shown as a cylindrical body as the tubular structure 114 in a roughly angular configuration relative to connector 116. Clip 110, and specifically the tubular structure 114, is structured to contain the light source 154 and to allow any of the necessary wires, batteries, or other means for supplying electricity or other power to the light source 154. Clip 110 can be a cup-like or cylindrical structure having an open bottom 128 and an open top 126. Bottom 128 can be configured to rest snugly against housing connector 118 such that light from the light source 154 is more efficiently provided to the spa feature. Other embodiments of the clip 110 also allow for the tubular structure 114 and the connector 116 to be in a perpendicular configuration, a parallel configuration, or at other angles to each other.

The tubular structure 114 for containing and/or supporting the light source 154 can be of various sizes and shapes depending on the desired light source 154. For example, a relatively small cylindrical structure can be used as the tubular structure 114 for LEDs and mini-bulbs while a relatively large hollow structure can be used for more conventional or older bulbs. Light source 154 is inserted into the clip 110 via a hole in the top 126 so as to be retained within the hollow interior 156 of tubular structure 114.

The connector 116 for attaching the clip 110 to the housing connector 118 can be structured to cooperate with the housing connector 118, or can be a spring clip or other connectorless connection device. For example, the connector 116 can be a C-shaped structure to slide over and frictionally connect to a T-shaped housing connector 118. When the clip 110 is attached to the housing connector 118, the light source 154 is in a position to provide light to the spa feature. The exact shape of the connector 116 should match and cooperate with the shape of the housing connector 118 as disclosed herein.

FIG. 13 is an exploded perspective view of a spa feature showing a use of a clip 110 according to the second embodiment of the invention. The illustrated spa feature is a bulkhead light fitting for placement on or through a spa wall, and preferably on or through an outer decorative or supporting wall. The bulkhead light fitting comprises a one or two piece structured or molded base component 180 that is mounted through the spa wall, a sealing gasket 176, a nut 178 or other means for securing the base component 180 on the spa wall, a lens or light diffuser 182, a decorative and/or functional light shade 170, and an attachment plate 172 for attaching the light shade 170 onto the base component 14. The base component 180 comprises a body 174 and a lens or light diffuser 182, comprising at least one housing connector 118.

In the embodiment of the housing connector 118 shown in FIG. 13, housing connector still is a generally T-shaped structure, but having a saddle 160 structure into which the light source 154 can fit. For example, after clip 110 is attached to housing connector 118, light source 154 is inserted into tubular structure 114 via open top end 126, and slid down the length of tubular structure 114 until the light source 154 enters and/or contacts the saddle 160. Using such a saddle 160 allows the light source 154 to be closer to the spa feature and to transmit light more directly to the spa feature.

FIG. 14 is a rear view of a spa feature showing a use of a clip 110 according to the second embodiment of the invention. The spa feature is the same spa feature shown in FIG. 13. As can be seen, connector 116 has a generally C-shape that cooperates with the generally T-shape of housing connector 118 so as to secure the clip 11 onto the spa feature.

FIG. 15 is a bottom view of a waterjet 112 showing a housing connector 118 suitable for use with a clip 110 according to the second embodiment of the invention. On this waterjet 112, two housing connectors 118 are shown in side profile.

FIG. 16 is a perspective view showing a clip 110 according to the second embodiment of the invention mounted on a waterjet housing 12, such as that shown in FIG. 15. IN this view, it can be seen how the connector 116 cooperates with the housing connector 118.

In operation and use, a waterjet comprising clip 10, 110 and a light emitting device provides an aesthetically pleasant illuminated jet body flange 52 and/or an illuminated stream of water into spa 50. Similarly, a spa feature comprising clip 10, 110 can be illuminated to present an aesthetically pleasant illuminated spa feature, or to illuminate the interior of the spa tub, the spa deck, or areas around the spa.

Housing 12, waterjet 112, and other spa features can be a typical or known housing structure, but preferably being manufactured at least in part from a clear plastic or other material to allow the transmission of light therethrough. Similarly, the nozzle structure (not shown) can be a typical or known nozzle structure, but preferably being manufactured from a clear material to allow the transmission of the light therethrough. Further, additional components of the waterjet structure also preferably are manufactured from a clear plastic or other material also so as to allow the transmission of light therethrough.

Clip 10, 110 and the various components of the invention can be manufactured from relatively inexpensive materials. Preferably, clip 10, 110 can be molded or formed from a plastic material that will not corrode or be adversely affected from the exposure to water, particularly chlorinated water. Such plastics and other materials are known in the art.

The foregoing detailed description of the preferred embodiments and the appended figures have been presented only for illustrative and descriptive purposes and are not intended to be exhaustive or to limit the scope and spirit of the invention. The embodiments were selected and described to best explain the principles of the invention and its practical applications. One of ordinary skill in the art will recognize that many variations can be made to the invention disclosed in this specification without departing from the scope and spirit of the invention.

What is claimed is:

1. A clip system for a waterjet housing structure, the clip system comprising:

a substantially T-shaped housing connector portion corresponding to the waterjet housing structure;

a light emitting device; and a clip, the clip configured to detachably engage to the waterjet housing structure via the T-shaped housing connector portion, the clip also configured to hold the light emitting device, the clip comprising:

a) a clip connector portion comprising a C-shaped structure defining a slot shaped to complement the substantially T-shaped housing connector portion, the clip connector portion configured to receive the substantially T-shaped housing connector portion within the slot, and b) a support structure portion having a first end, a second end, and a hollow interior defined therebetween, the first end proximate to the clip connector portion, the second end extending away from the clip connector portion such that the support structure portion is positioned at an acute angle relative to the clip connector portion, the second end configured to receive the light emitting device;

wherein the clip connector portion detachably engages the clip to the waterjet housing structure such that the support structure portion extends away from, and is positioned at the acute angle relative to, the waterjet housing structure;

wherein the light emitting device, is inserted within the hollow interior of the clip, to allow the light emitting device to emit the light to a spa feature.

2. The clip as claimed in claim 1, wherein the first end and the second end of the support structure portion each, respectively, define an opening, the opening at the second end configured to access the hollow interior.

3. The clip as claimed in claim 2, wherein: the opening at the first end of the support structure portion is also configured to access the hollow interior.

4. The clip as claimed in claim 1, wherein:

the second end of the support structured portion defines an opening configured to access the hollow interior.

5. The clip as claimed in claim 1, wherein the support structure portion is tubular in shape between the first end and the second end.

6. The clip as claimed in claim 1, wherein:

the first end and the second end of the support structure portion each, respectively, defines an opening, the opening at the first end configured to access the hollow interior, the opening at the second end configured to access the hollow interior and configured to access the slot;

the hollow interior is also configured to receive the light emitting device that extends through the opening at the second end, through the hollow interior, and through the opening at the first end; and the light emitting device extends out through the opening at the first end, into the slot.

* * * * *